US006937243B2

(12) United States Patent
Tu et al.

(10) Patent No.: US 6,937,243 B2
(45) Date of Patent: Aug. 30, 2005

(54) TRANSMISSION CIRCUIT AND MANUFACTURE METHOD FOR THE SAME

(75) Inventors: Chun-An Tu, Tainan (TW); Chih-Yu Chang, Fengyuan (TW); Chien-Chou Cheng, Tainan (TW)

(73) Assignee: Silicon Intergrated Systems Corporation, Hsinchu (TW)

( * ) Notice: Subject to any disclaimer, the term of this patent is extended or adjusted under 35 U.S.C. 154(b) by 401 days.

(21) Appl. No.: 10/200,343

(22) Filed: Jul. 23, 2002

(65) Prior Publication Data

US 2004/0029344 A1 Feb. 12, 2004

(51) Int. Cl.[7] ..... G09G 5/39
(52) U.S. Cl. ..... 345/531; 345/520
(58) Field of Search ..... 345/501, 519, 345/520, 531, 541, 542; 710/100, 305, 306, 309

(56) References Cited

U.S. PATENT DOCUMENTS 6,052,133 A * 4/2000 Kang ..... 345/532
6,292,201 B1 * 9/2001 Chen et al. ..... 345/519
6,346,946 B1 * 2/2002 Jeddeloh ..... 345/503
6,469,703 B1 * 10/2002 Aleksic et al. ..... 345/542
2002/0085013 A1 * 7/2002 Lippincott ..... 345/572

* cited by examiner

*Primary Examiner*—Kee M. Tung

(57) ABSTRACT

A transmission circuit has a dispatching circuit and a calculating circuit. The transmission circuit is between a processing circuit and a memory controller. The processor is connected to the dispatching circuit via a first signal line. The dispatching circuit is connected to the calculating circuit via a second signal line. The calculating circuit is connected to the memory controller via a third signal line. Besides, a fast signal line is provided for connecting the dispatching circuit and the memory controller. During operation, the processing circuit transmits a data stream to the dispatching circuit. The dispatching circuit checks whether a speed-up condition is satisfied. If the speed-up condition is not satisfied, the data stream follows a conventional path through the calculating circuit. If the speed-up condition is satisfied, the data stream is directly transmitted to the memory controller and such design increases the performance of the transmission circuit.

20 Claims, 5 Drawing Sheets

TRANSMISSION CIRCUIT AND MANUFACTURE METHOD FOR THE SAME

BACKGROUND OF THE INVENTION

1. Field of Invention

The present invention relates to transmission circuits and methods and in particular is related to transmission circuits and a manufacture method with dynamic paths for the same.

2. Description of Related Art

Computers have changed the world, and in the future, computers will increase their importance as the technology keeps advancing. Desktop versions as well as mobile phones utilize lots of technologies developed for computers. Apparently, more and more kinds of electronic devices will also share these technologies.

One important factor deciding the performance of computers is the architecture. The architecture includes the design of data flow. Even with a powerful processor, poorly designed data flow in a computer system still results in a poor performance.

FIG. 1 shows a conventional block diagram of a computer system. A CPU 101 is connected to an integrated circuit that includes a core logic circuit 102, a VGA circuit 103, and a DRAM controller 104. The DRAM controller 104 is further connected to a DRAM 105. Graphic data are firstly generated by the CPU 101 according to a running program. Then, these graphic data are sent to the core logic circuit 102. The core logic circuit 102 then dispatches these graphic data to the VGA circuit 103. After processed by the VGA circuit 103, proper data are transmitted to the DRAM controller 104, and are outputted to the DRAM 105 later.

The problem is that the signal line between the CPU 101 and the core logic circuit 102 often has larger bandwidth than the signal line between the core logic circuit 102 and the VGA circuit 103 does. In other words, the core logic circuit 102 needs several clock cycles to deliver data received in one cycle. Such design wastes time and results in poor performance.

Besides, not all data need be processed by the VGA circuit 103 before they are transmitted to the DRAM controller 104. However, these data still need to pass through the VGA circuit 103 and such design causes an unnecessary time delay. However, it is expensive to enlarge the bandwidth between the core logic 102 and the VGA circuit 103.

SUMMARY OF THE INVENTION

Therefore, the goal of the present invention is to provide an efficient architecture is cost efficient.

An embodiment of the present invention is a transmission circuit that includes a dispatching circuit and a calculating circuit. Examples of the dispatching circuits include core logic circuits in computer chipsets, and examples of the calculating circuits include VGA circuits. The transmission circuit is between a processing circuit and a memory controller circuit. The processing circuit is connected to the dispatching circuit via a first signal line. The dispatching circuit is connected to the calculating circuit via a second signal line. The calculating circuit is connected to the memory controller circuit via a third signal line. The memory controller circuit is connected to a memory device, e.g. DRAM.

In addition, a fast signal line is provided to connect the dispatching circuit and the memory controller circuit. During operation of the transmission circuit, the processing circuit transmits a data stream to the dispatching circuit. The dispatching circuit detects whether a speed-up condition is satisfied. If the speed-up condition is satisfied, the data stream is transmitted to the memory controller circuit via the fast signal line directly. Otherwise, the data stream is transmitted to the calculating circuit for further processing before data are written to the memory.

The speed-up condition includes detecting whether the data are of proper types to be directly transmitted to the memory controller circuit. Also, the speed-up condition includes detecting whether the fast signal line is enabled or available. Further, the speed-up condition also includes detecting whether the calculating circuit is in an idle mode. When the calculating circuit is in the idle mode, no danger of sequence order exists for directly transmitting the data stream to the memory controller circuit.

Hence, the goal of an efficient architecture efficient with a low cost is achieved by the present invention. It is therefore an objective of the present invention to provide

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DESCRIPTION OF THE PREFERRED EMBODIMENTS

The present invention discloses a transmission circuit and a method providing dynamic transmission paths for speeding the transmission between a processor circuit and a memory controller circuit.

Figure 2:
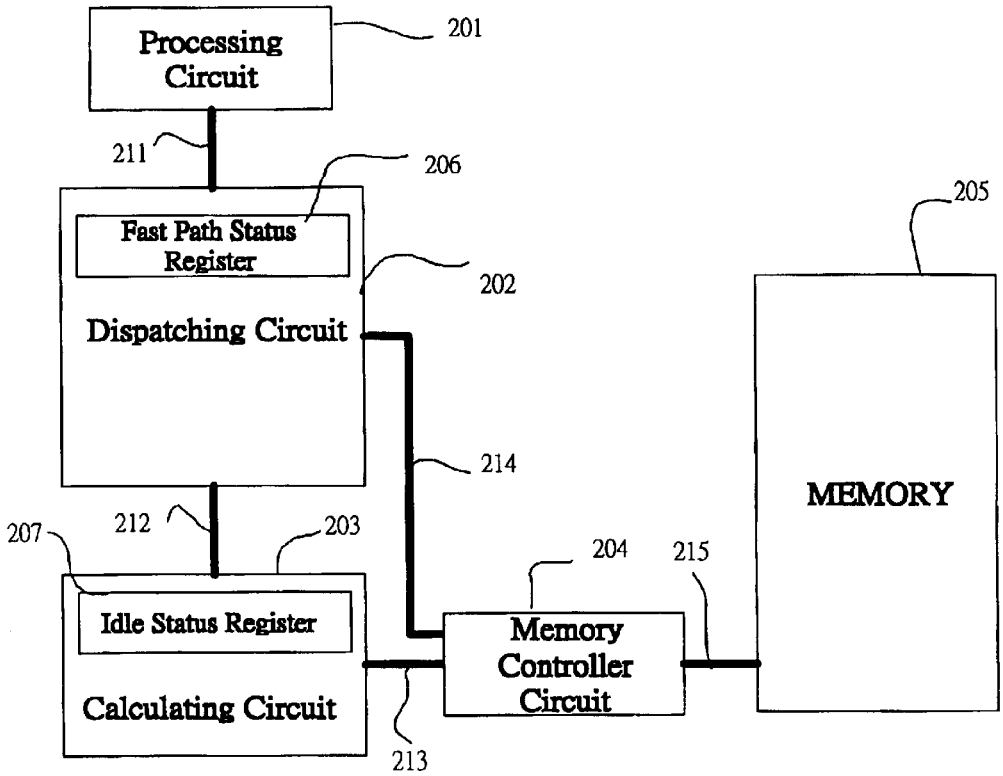
FIG. 2 is a diagram illustrating an embodiment of a transmission architecture of the present invention.
Figure 3:
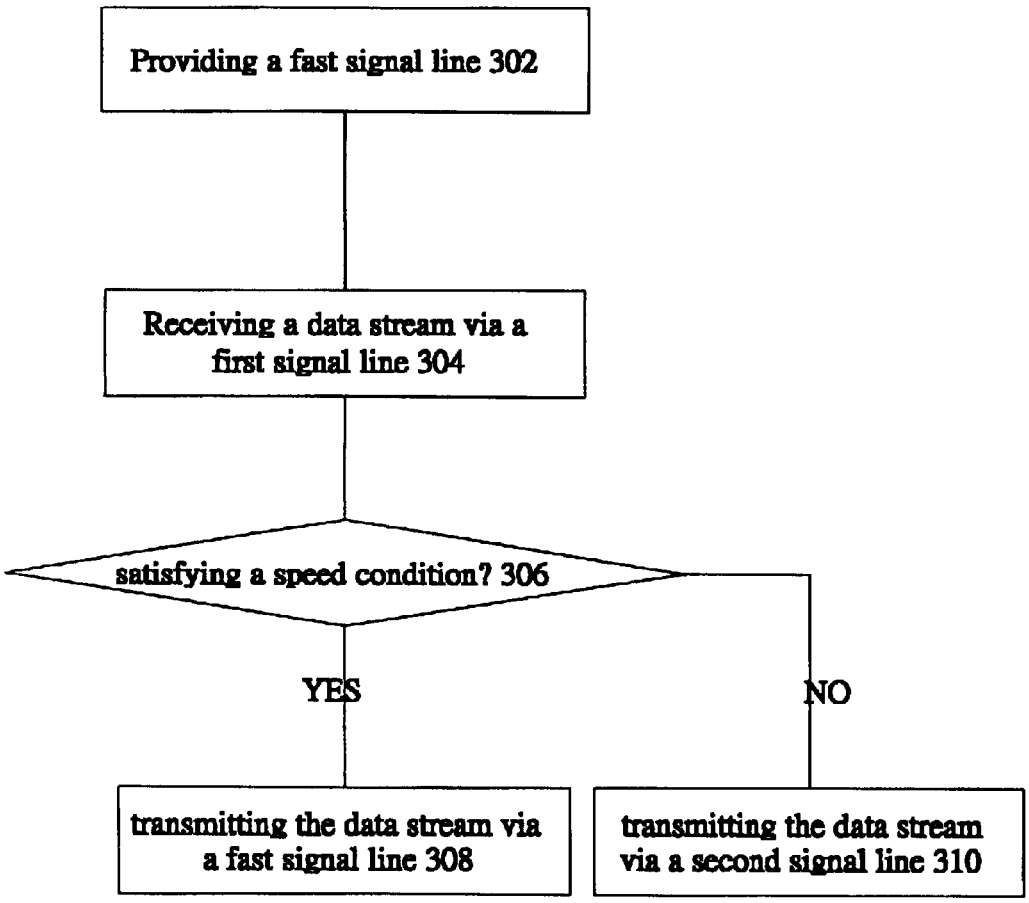
FIG. 3 is a flowchart illustrating an operation of the embodiment in FIG. 2.

Reference is made to FIG. 2. A transmission circuit embodiment of the present invention is located between a processing circuit 201 and a memory controller circuit 204. The memory controller 204 is further connected to a memory 205 via a memory signal line 215. The transmission circuit includes a dispatching circuit 202 and a calculating circuit 203.

The dispatching circuit 202 is connected to the processing circuit 201 via a first signal line 211. The dispatching circuit 202 is also connected to the calculating circuit 203 via a second signal line 212. Further, the calculating circuit 203 is connected to the memory controller circuit 204 via a third signal line 213. Besides, a fast signal line 214 is provided for a direct connection between the dispatching circuit 202 and the memory controller circuit 204.

The bandwidths of the first signal line 211 and the fast signal line 214 are both larger than the that of the second signal line 212. In other words, the dispatching circuit 202 needs more transmission time to transmit data to the calculating circuit 203 than receiving time to receive the data. For example, in the case where the first signal line 211 has a width of 256 bits and the second signal line 212 has a width of 64 bits, the dispatching circuit 203 needs four clock cycles to transmit data received from the processing circuit 201 in one clock cycle.

Examples of the processing circuit 201 include central processing units (CPUs) in various kinds of computer architectures. Also, examples of the processing circuit 201 include any micro-controllers or processors in various kinds of circuits. Besides, examples of the dispatching circuit 202 include common core logic circuits in chipset integrated circuits. Also, examples of the dispatching circuit 202 include any logic circuits that are designed to perform data dispatching in various kinds of circuits. Further, examples of the calculating circuit 203 include graphical processors, audio processors, I/O processors, and any circuits for performing a calculating work.

Figure 1:
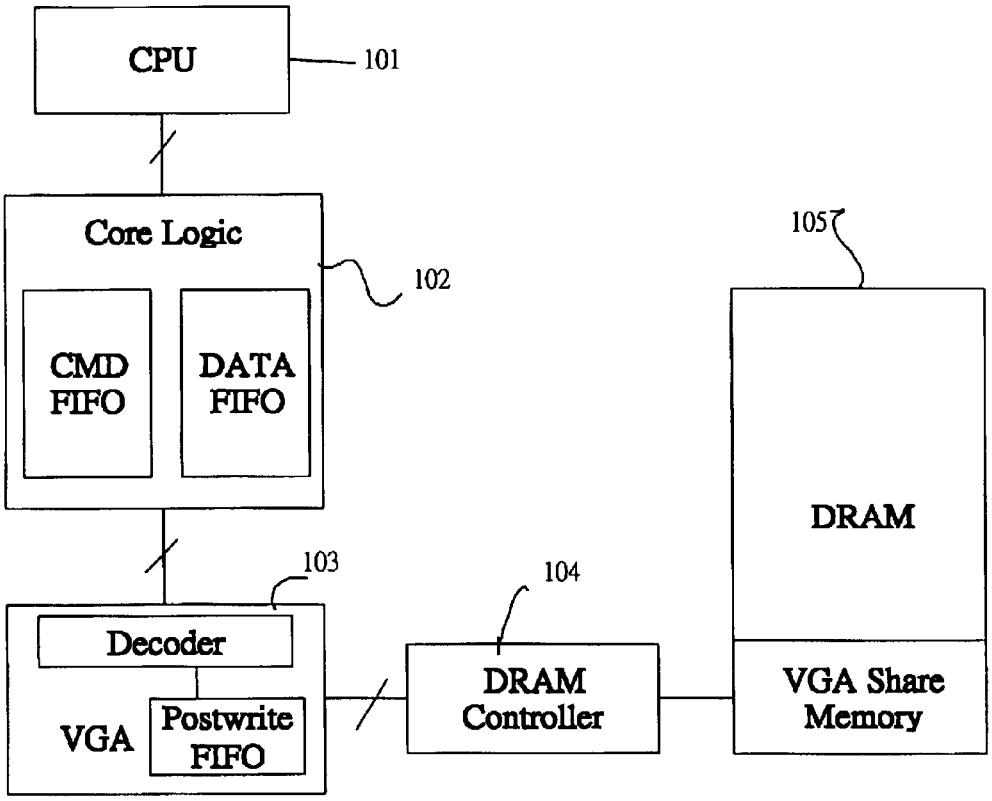
Fig.1(Prior Art)
FIG. 1 is a diagram illustrating a transmission architecture of prior art.

To explain the operation of the embodiment as mentioned above, reference is made to both FIG. 1 and FIG. 2. FIG. 2 is a flowchart illustrating the operation process of the transmission circuit in FIG. 1.

In advance, the fast signal line 214 is provided to connect the dispatching circuit 202 and the memory controller circuit 204 (step 302). During operation, the processing circuit 201 produces a data stream comprising a series of data feeding to the dispatching circuit 202 (step 304). The dispatching circuit 202 includes logic to check whether the transmission circuit satisfies a speed-up condition in a moment of processing (step 306). If the speed-up condition is satisfied, the dispatching circuit 202 transmits the data stream to the memory controller circuit 204 via the fast signal line 214 (step 308). If the speed-up condition is not satisfied, the dispatching circuit 202 transmits the data stream to the calculating circuit 203 (step 310).

The data stream includes data of a first type and data of a second type. The data of the first type need to be processed first by the calculating circuit 203. For example, data of the first type are IO instructions, 2D or 3D instructions for rendering a 2D or 3D pictures. Without first being processed by the calculating circuit 203, data of the first type cannot be written into the memory 205 directly. In contrast, data of the second type are data that can be directly written into the memory 205. For example, data of the second type are images or linear data already calculated by the processing circuit 201. The speed-up condition is not satisfied when the dispatching circuit 202 finds that it is processing data of the first type because data of the first type need to be firstly calculated or processed by the calculating circuit 203. In other words, the fast signal line 214 is only used for data of the second type, but not for the first type.

Besides, for the case that the data stream is composed of data of both the first type and the second type, sequences of the data being written to the memory are important. When the sequence of data is reversed, the output may be seriously mistaken. Therefore, the speed-up condition also includes a check of the status of the calculating circuit 203. When the calculating circuit 203 is idle, there is no danger of using the fast signal line 214 for transmission of the data stream. The status of the calculating circuit 203 may be stored in an idle status register 207. Further, the status of the calculating circuit 203 may also be stored in any kind of memory. Besides, the status of the calculating circuit 203 may be passively acquired by the dispatching circuit 202 or be actively informed by the calculating circuit 203 to the dispatching circuit 202.

Further, in the embodiment mentioned above, the transmission circuit also has a fast path status indicating whether a fast signal line 214 is available or enabled. This fast path status can be stored in a register 206 or in any kind of memory. The fast path status may also be set outside the dispatching circuit 202. The speed-up condition is not satisfied when the fast path status shows that the fast signal line 214 is not enabled or available.

Figure 4:
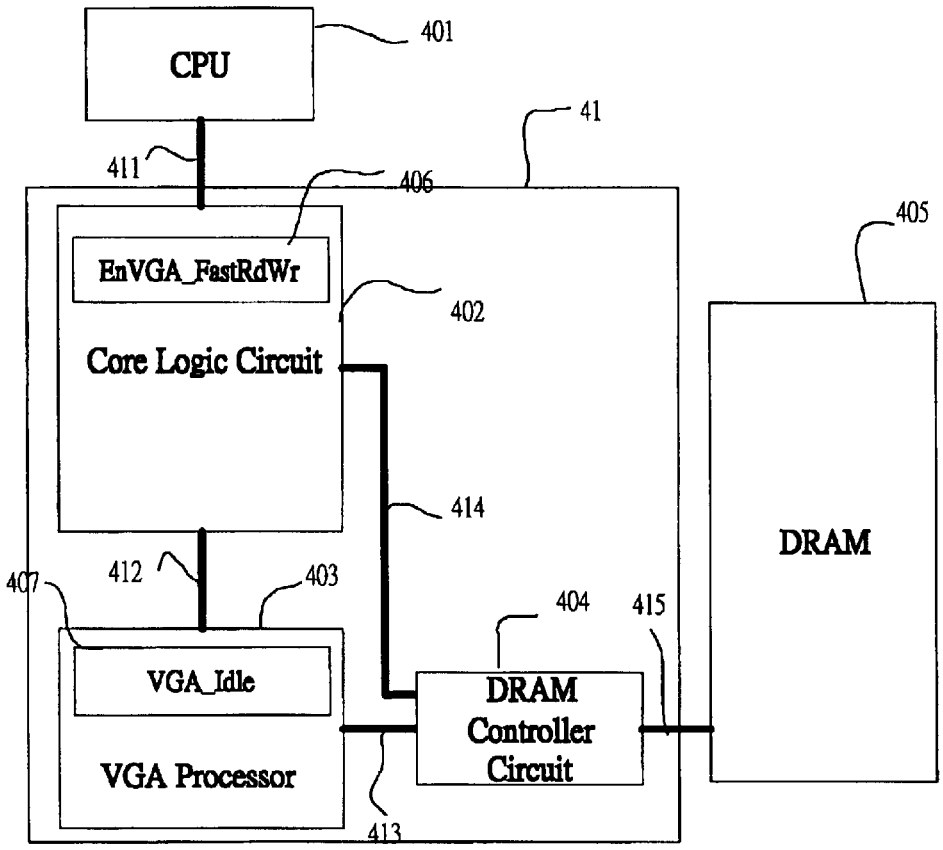
FIG. 4 is a diagram illustrating an example of a transmission circuit of the present embodiment.
Figure 5:
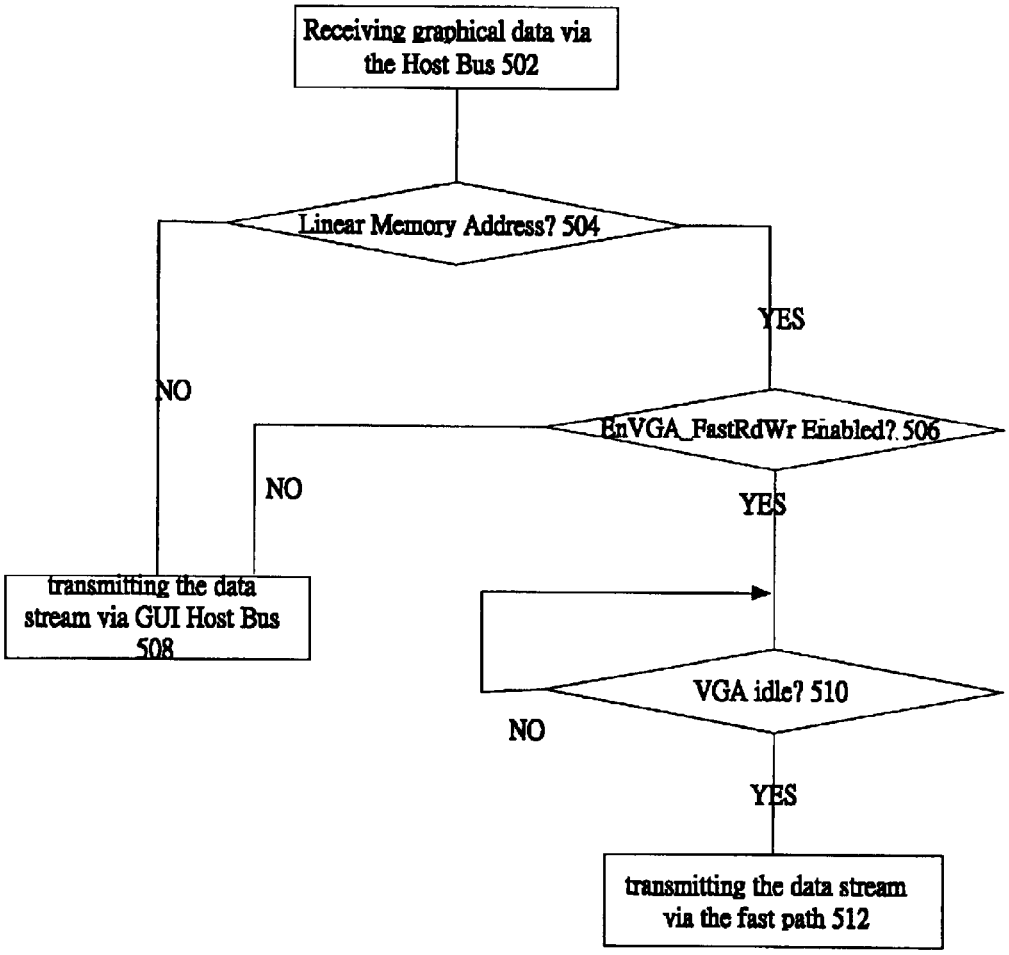
FIG. 5 is a flowchart illustrating an operation of the example in FIG. 4.

For a clear description of the present invention, a practical example is provided as follows. Reference is made to FIG. 4 and FIG. 5.

The example shown in FIG. 4 is applied in currently popular computer architectures. A CPU 401 is connected to an integrated circuit (IC) 41 of a chipset. Typically, the IC between the CPU and the DRAM is called the north bridge chip.

The IC 41 includes a core logic circuit 402 as the dispatching circuit, a VGA circuit 403 as the calculating circuit, and a DRAM controller circuit 404 as the memory controller circuit. The CPU 401 is connected to the core logic circuit 402 via a HOST bus 411 with width of 256 bits as the first signal line. The core logic 402 is connected to the VGA circuit 403 via a GUI host bus 412 with width of 64 bits a second signal line. The VGA circuit 403 is connected to the DRAM controller circuit 404 via a DRAM data bus with width of 128 bits as the third signal line. Besides, a fast path 414 is provided for connection between the core logic circuit 402 and the DRAM controller circuit 404. The fast path 414 has width of 128 bits as the fast signal line. Examples of the DRAM 405 include types of 128-bits balanced SDR128 or 256-bits balanced DDR256.

A status register 406 stores a variable EnVGA_FastRdWr indicating whether the fast path 414 is available or enabled. Another status register 407 stores a variable VGA_Idle indicating whether the VGA circuit 403 is in an idle status.

Reference is made to FIG. 5, which is a flowchart illustrating the operation of the example shown in FIG. 4. At first, graphic data are received from the CPU 401 (step 502). The core logic circuit 402 detects whether the data received is of a linear memory type, which is not necessarily processed by the VGA circuit 403 before transmission to the DRAM controller circuit 404 (step 504). If the data received are not of a linear memory type, which means the speed-up condition is not satisfied, the data received are transmitted to the VGA circuit 403 via the GUI Host Bus 412 (step 508). Otherwise, the core logic circuit 402 checks whether the EnVGA_FastRdWr is true (step 506). If the EnVGA_FastRdWr is false, which means no fast path 414 is enabled or available, the data received are also transmitted to the VGA circuit 403 via the GUI Host Bus 412 (step 508).

Next, the core logic circuit 402 continues to check whether the VGA circuit 403 is in an idle mode (step 510). If the VGA circuit 403 is in the idle mode, which means the speed-up condition is satisfied, the data received are directly transmitted to the DRAM controller circuit 404 via the fast path 414 (step 512).

With the description and examples provided above, implementation of the present invention will be obvious to persons skilled in the art. At the same time, it is clear that the present invention has at least the following advantages.

First, for burst linear memory commands, which are often the bottleneck of performance, we provide an efficient bus for the data transmission. Second, it is not necessary to change any software design because the present invention is software-transparent. Third, the modification has a low cost. Fourth, for those data routed through the fast path, the latency time is reduced by skipping the pass through the VGA circuit or other calculating devices.

Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A transmission circuit with dynamic path adjustment, said transmission circuit being between a processing circuit and a memory controller circuit and said transmission circuit receiving a data stream from said processing circuit, said transmission circuit comprising:

a dispatching circuit connected to said processing circuit via a first signal line;

a calculating circuit connected to said dispatching circuit via a second signal line and connected to said memory controller circuit via a third signal line; and a fast signal line providing a connection between said dispatching circuit and said memory controller circuit, wherein:

bandwidths of said first signal line and said fast signal line are both larger than bandwidth of said second signal line; and when said dispatching circuit detects said transmission circuit satisfies a speed-up condition, said dispatching circuit transmits said data stream directly to said memory controller circuit via said fast signal line, and when said dispatching circuit detects said transmission circuit fails to satisfy said speed-up condition, said dispatching circuit transmits said data stream to said calculating circuit via said second signal line.

2. The transmission circuit of claim 1, wherein said data stream selectively comprises data of a first type and data of a second type, said data of the first type need to be processed by said calculating circuit, said data of second type do not need to be processed by said calculating circuit before transmitting to said memory controller circuit, and said speed-up condition is not satisfied except when said dispatching circuit processes said second type of data.

3. The transmission circuit of claim 2, wherein said speed-up condition is not satisfied except when said calculating circuit is idle.

4. The transmission circuit of claim 3, further comprising an idle status means for storing and setting a status representing whether said calculating circuit is in an idle status, wherein said dispatching circuit accesses said idle status means for checking whether said calculating circuit is in said idle status.

5. The transmission circuit of claim 3, further comprising a fast path status means for storing a fast path status representing whether said fast signal line is enabled, wherein said dispatching circuit accesses said fast path status means for obtaining said fast path status, and said speed-up condition is not satisfied unless said fast signal line is enabled.

6. The transmission circuit of claim 5, wherein said processing circuit is a central processing unit, and said calculating circuit is a graphic processing circuit.

7. The transmission circuit of claim 6, wherein said transmission circuit is embedded in an integrated circuit of a chipset.

8. The transmission circuit of claim 7, wherein said first signal line has a width of 256 bits, said second signal line has a width of 64 bits, said third signal line has a width of 128 bits, and said memory controller circuit is connected to a dynamic random access memory.

9. A method for dynamic adjusting a path in a transmission circuit between a processing circuit and a memory controller circuit, said transmission circuit comprising a dispatching circuit and a calculating circuit, said dispatching circuit being connected to said processing circuit via a first signal line, said calculating circuit being connected to said dispatching circuit via a second signal line, and said calculating circuit also being connected to said memory controller circuit, said method comprising:

providing a fast signal line for connecting said dispatching circuit to said memory controller circuit, wherein said first signal line and said fast signal line both have larger bandwidths than said second signal line does;

receiving a data stream from said processing circuit by said transmission circuit;

when said transmission satisfies a speed-up condition, transmitting said data stream by said dispatching circuit to said memory controller circuit via said fast signal line, and when said transmission does not satisfy said speed-up condition, transmitting said data stream by said dispatching circuit to said calculating circuit via said second signal line.

10. The method of claim 9, wherein said data stream selectively comprises data of a first type and data of a second type, said data of the first type need to be processed by said calculating circuit, said data of the second type do not need to be processed by said calculating circuit before transmission to said memory controller circuit, and said speed-up condition is not satisfied except when said dispatching circuit processes said second type of data.

11. The method of claim 10, wherein said speed-up condition is not satisfied except when said calculating circuit is idle.

12. The method of claim 11, wherein said transmission circuit further comprises an idle status means for storing and setting a status representing whether said calculating circuit is in an idle status, and wherein said dispatching circuit accesses said idle status means for checking whether said calculating circuit is in said idle status.

13. The method of claim 11, wherein said transmission circuit further comprises a fast path status means for storing a fast path status representing whether said fast signal line is enabled, wherein said dispatching circuit accesses said fast path status means for obtaining said fast path status, and said speed-up condition is not satisfied unless said fast signal line is not enabled.

14. The method of claim 13, wherein said processing circuit is a central processing unit, and said calculating circuit is a graphic processing circuit.

15. The method of claim 14, wherein said transmission circuit is embedded in an integrated circuit of a chipset.

16. The method of claim 15, wherein said first signal line has a width of 256 bits, said second signal line has a width of 64 bits, said third signal line has a width of 128 bits, and said memory controller circuit is connected to a dynamic random access memory.

17. A transmission circuit embedded in an integrated circuit of a chipset, said integrated circuit being between a central processing unit and a memory controller circuit, said transmission circuit comprising:

a dispatching circuit for receiving graphic data from said central processing unit via a first signal line;

a graphic processing circuit connected to said dispatching circuit via a second signal line and connected to said memory controller circuit via a third signal line; and a fast signal line for connecting said dispatching circuit and said memory controller circuit, wherein:

said first signal line and said fast signal line both have larger bandwidths than said second signal line does; and when said dispatching circuit detects said transmission satisfies a speed-up condition, said dispatching circuit transmits said graphic data to said memory controller circuit via said fast signal line, and when said dispatching circuit detects said transmission circuit does not satisfy said speed-up condition, said dispatching circuit transmits said graphic data to said graphic processing device via said second signal line.

18. The transmission circuit of claim 17, further comprising a fast path status means for storing a fast path status representing whether said fast signal line is enabled, wherein said dispatching circuit accesses said fast path status means for obtaining said fast path status, and said speed-up condition is not satisfied unless said fast signal line is enabled.

19. The transmission circuit of claim 18, wherein said speed-up condition is not satisfied except when said calculating circuit is idle.

20. The transmission circuit of claim 19, wherein said first signal line has a width of 256 bits, said second signal line has a width of 64 bits, said third signal line has a width of 128 bits, and said memory controller circuit is connected to a dynamic random access memory.

* * * * *

UNITED STATES PATENT AND TRADEMARK OFFICE

CERTIFICATE OF CORRECTION

PATENT NO. : 6,937,243 B2
DATED : August 30, 2005
INVENTOR(S) : Chun-An Tu

It is certified that error appears in the above-identified patent and that said Letters Patent is hereby corrected as shown below:

Title page,
Item [73], should read:
-- [73] Assignee: Silicon Integrated Systems Corporation, Hsinchu (TW) --.

Signed and Sealed this

Seventh Day of February, 2006

JON W. DUDAS
*Director of the United States Patent and Trademark Office*